US006299035B1

(12) United States Patent
Dalhart

(10) Patent No.: US 6,299,035 B1
(45) Date of Patent: Oct. 9, 2001

(54) REMOTELY ACTIVATED DISPENSER

(75) Inventor: Mark D. Dalhart, Mason, OH (US)

(73) Assignee: Hydro Systems Company, Cincinnati, OH (US)

( * ) Notice: Subject to any disclaimer, the term of this patent is extended or adjusted under 35 U.S.C. 154(b) by 0 days.

(21) Appl. No.: 09/687,330

(22) Filed: Oct. 13, 2000

(51) Int. Cl.[7] ..... B67D 3/00

(52) U.S. Cl. ..... 222/505; 222/527; 222/529; 239/578

(58) Field of Search ..... 222/505, 527, 222/529; 239/578; 251/33; 451/90

(56) References Cited

U.S. PATENT DOCUMENTS

| | | | | |
|---|---|---|---|---|
| 1,158,079 | | 10/1915 | Saunders . | |
| 1,241,437 | | 9/1917 | Pian . | |
| 1,745,972 | * | 2/1930 | Beck | 239/578 |
| 2,753,664 | | 7/1956 | Garver . | |
| 3,139,238 | | 6/1964 | Norstrud et al. . | |
| 3,369,705 | | 2/1968 | Curtis et al. . | |
| 4,262,822 | * | 4/1981 | Corte | 239/578 |
| 4,457,472 | * | 7/1984 | Gebert, Jr. | 239/578 |
| 4,588,318 | | 5/1986 | O'Brien et al. . | |
| 4,651,930 | | 3/1987 | Magaha, Jr. . | |
| 4,722,460 | | 2/1988 | Madsen . | |
| 4,729,135 | | 3/1988 | Titterington . | |
| 4,856,756 | | 8/1989 | Combs . | |
| 4,926,514 | | 5/1990 | Leuenberger . | |
| 5,462,254 | | 10/1995 | Müller . | |

* cited by examiner

*Primary Examiner*—Philippe Derakshani
*Assistant Examiner*—Thach H. Bui
(74) *Attorney, Agent, or Firm*—Wood, Herron & Evans, LLP

(57) ABSTRACT

A remote activation dispensing apparatus for dispensing fluids. An actuating device positioned on a dispensing tube is operably connected to a flexible elongated member, which is operably connected to a valve in a dispensing unit. Upon manipulation of the actuating device, the valve is actuated for passing or cutting off fluids from the dispensing unit to the dispensing tube.

49 Claims, 3 Drawing Sheets

REMOTELY ACTIVATED DISPENSER

FIELD OF THE INVENTION

This invention relates to fluid handling, and more particularly to remotely activated dispensing of fluids from a proportioning apparatus.

BACKGROUND OF THE INVENTION

It is known to dispense concentrated chemical fluids by siphoning them through a venturi into a water stream and dispensing a flow of mixed water and chemicals. Mixers known as eductors, aspirators or proportioners accomplish this task by providing a water flow through a venturi section and siphoning chemicals into the flow through a low pressure orifice in the venturi section. Such eductors are useful in a number of applications, such as in dispensing diluted cleaning agents for cleaning procedures.

In these proportioning systems, it is important to maintain the water source free of cross-connection so that the chemicals are not drawn back into the water source. This has been accomplished through the use of integrated backflow preventers such as air gap eductors, hose connection vacuum breakers, atmospheric vacuum breakers, pipe interrupters and elastomer gap eductors (e-gaps). In a typical application, such air gap eductors include a nozzle upstream of the venturi section for defining a stream of water flowing across an unobstructed gap in the eductor body prior to entering the venturi section. Upon any water shutdown or pressure reversal in the water system, the water stream terminates, leaving a gap in the eductor between the nozzle and the venturi section where the chemical is otherwise first introduced. There is thus no mechanism capable of transmitting chemicals back to the nozzle or upstream in the water supply. Forms of air gap eductors are disclosed, for example, in U.S. Pat. Nos. 5,519,958; 5,522,419; 5,253,677 and 5,862,829. Whichever the type of backflow preventer used, the chemicals are prevented from flowing back into the water supply. In these proportioning systems, water regulatory authorities do not permit shutoff valves to be located downstream of the backflow protectors.

The eductor in a proportioning apparatus is typically connected to a discharge tube or hose for dispensing the fluid. One use for the apparatus is to fill a mop bucket or a floor scrubbing machine. For this use, a user must hold the discharge tube in one hand and activate the dispenser with the other hand. This two-handed operation is not user friendly, particularly where the dispenser is tucked into a small custodial closet where it is connected to the water source thereby making it difficult to dispense the fluid from a distance greater than the operator's arm span. It is thus desirable to have a dispensing or proportioning apparatus capable of dispensing fluid without the operator being near the dispenser, but which also meets regulatory requirements for chemical backflow protection and shut-off valves.

SUMMARY OF THE INVENTION

There is provided a dispensing apparatus that may be activated remotely to dispense proportioned fluids. To this end, a dispensing unit is equipped with a valve for passing or cutting off fluid flow through a proportioner to a dispensing tube. A flexible elongated member is operably connected at one end to the valve and at the other end to an actuating device disposed near the discharge end of the dispensing tube. In an example of the present invention, the actuating device is a handle having a lever pivotally attached thereto, where upon pressing the lever the valve is actuated.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

The present invention provides a dispensing apparatus with remote activation capability for selectively initiating and cutting off the flow of a proportioned effluent through a discharge tube connected to and remote from a proportioning dispenser. To this end, and in accordance with the present invention, an actuator is provided near the discharge end of a dispensing tube connected to a dispensing unit including a proportioner or eductor. A flexible member, such as a cable, is operably connected at one end to the actuator and at the other end to a shut-off valve located on the dispensing unit. Upon operation of the actuator, the flexible member actuates the valve to selectively initiate and cut off flow of a proportioned effluent through the dispensing tube.

Figures 1, 2:
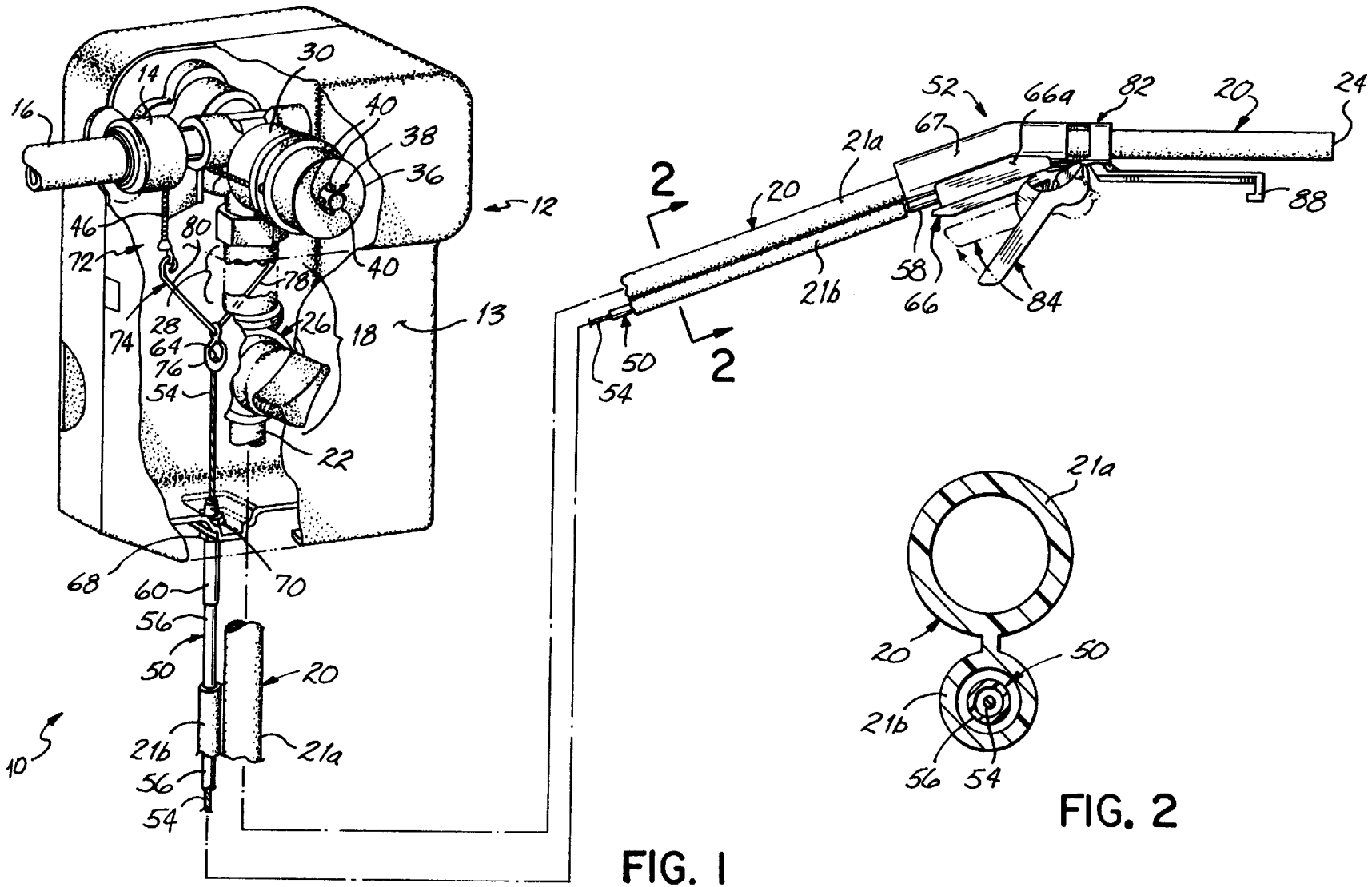
FIG. 1 is a partially cut-away perspective view of a housing and an elevational view of a remotely activated dispensing apparatus of the present invention.
FIG. 2 is an enlarged cross-sectional view of the dispensing tube in FIG. 1, as taken along line 2—2.

Referring to the Figures, where like numerals are used throughout to refer to like parts, FIG. 1 depicts in a partially cut away plan view a dispensing apparatus 10 in which the invention is used. A dispensing unit 12 includes a water inlet 14 adapted to connect to an inlet hose 16 connected to a water source (not shown). The water flow is fed to a proportioner or eductor 18 for combining the water with chemicals in a proportioned amount for dispensing through a dispensing tube 20. The dispensing tube 20 depicted in FIG. 1, and in cross-section in FIG. 2, includes two passageways 21*a*, 21*b*, which may be formed, by example, by co-extruding a plastic material, or by any other suitable process. The dispensing tube 20, particularly passageway 21*a*, has an inlet end 22 in communication with the dispensing unit 12 via attachment to the eductor 18, and a discharge end 24. Thus, passageway 21*a* is a fluid passageway. Passageway 21*b* will be explained in further detail below. The eductor 18 includes a venturi section 26 for taking in the desired chemicals and mixing them with the water, and a backflow preventer 28, such as an e-gap section or an air gap section, for preventing the backflow of chemicals to the water source. These proportioners or eductors 18 are known in the art, as described above, and do not per se form the present invention, but rather are usable with the present invention. As is known in the art, the backflow preventer may form a part of the eductor, or may be a separate component in the dispensing unit. Other types of proportioners/backflow preventers may be used without departing from the scope of the invention, but such devices should meet water regulations.

Figure 3:
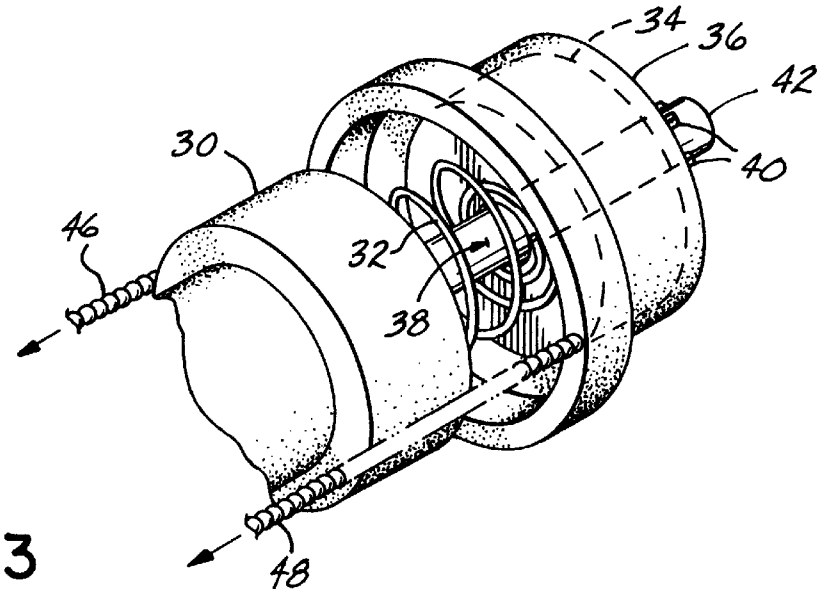
FIG. 3 is a perspective view of a valve for use in the present invention.

A valve 30, FIGS. 1 and 3, is positioned between the water inlet 14 and the proportioner 18, and is operable to permit water flow to the proportioner 18 or to cut off water flow to the proportioner 18. Thus, this valve 30 is positioned upstream of the eductor 18 so as to meet typical requirements of a Water Regulatory Authority. In an example of the present invention, the valve 30 is a poppet-actuated diaphragm valve, or simply a poppet valve, which is shown more fully in FIG. 3. This valve 30 includes a spring member 32 disposed adjacent a magnet 34 housed in a magnet cover 36. When the magnet 34 is held by the spring 32 in a rest position away from the valve 30, the valve 30 is closed to fluid flow. When the magnet 34 is moved toward the valve 30, the valve 30 is actuated to the open position to permit fluid to flow through. The magnet 34 and magnet cover 36 slide over a stem portion 38, which may have tabs 40 at a top portion 42 thereof to stop the spring member 32 from pushing the magnet 34 beyond a certain point. It is to be understood that valves other than the poppet valve shown may be used in the present invention. FIG. 3 also depicts two ball chains 46,48 connected to the magnet cover 36 for pulling the magnet cover 36 and magnet 34 toward the valve 30, as will be described in more detail below. It will be appreciated that valve 30 is known in the art, and its details do not per se form the present invention, but rather are usable with the present invention.

A flexible elongated member 50 is operably connected to the valve 30 and to an actuator 52 located near the discharge end 24 of the dispensing tube 20. As shown in FIG. 2, the flexible elongated member 50 is disposed within passageway 21*b* of dispensing tube 20. Upon manipulating the actuator 52, the flexible member 50 causes the valve 30 to open or close to permit or prevent fluid flow through the valve 30 to the proportioner 18 and through fluid passageway 21*a* of dispensing tube 20. Because the flexible elongated member 50 is disposed within the passageway 21*b*, which is connected along its length to fluid passageway 21*a*, the flexible member 50 is prevented from twisting around the fluid passageway 21*a*. Such twisting might tension the actuator 52 upon pulling on the tube 20 so as to cause an unintentional actuation. It should be understood, however, that dispensing tube 20 may comprise a single passageway 21*a* for fluid flow, and the flexible member 50 may be separate along its length from the dispensing tube 20, or may be connected thereto in another manner.

Figure 4:
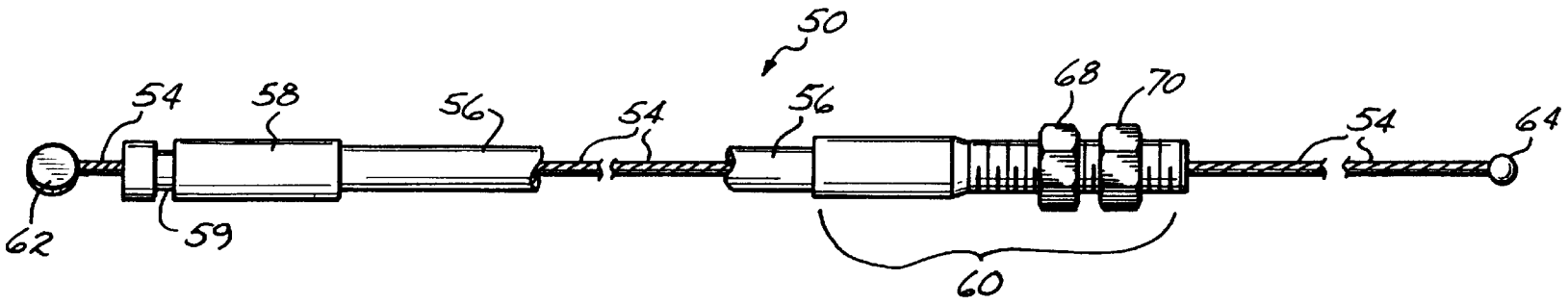
FIG. 4 is a plan view of a flexible elongated member for use in the present invention.

In FIG. 4, an embodiment of the flexible elongated member 50 is depicted. A stainless steel cable 54, or cable of any suitable material, runs through an outer jacket or sleeve 56 with a respective fitting 58,60 crimped on each end of the sleeve 56. Cast ends 62,64 on cable 54 secure the cable 54 in the sleeve 56 and prevent their separation. Cast ends 62, 64 further facilitate connection of the cable ends to the valve 30 and to the actuator 52. In this embodiment, cast end 62 is shown as a cylindrical end and cast end 64 is shown as a ball or spherical end. End 62 is shown in FIG. 1 attached to a lever 84 of actuator 52 (described below), while end 64 is shown attached to a clip 76 operably secured to valve 30 (described below). Fitting 58 is shown as a ferrule adapted to connect to a body portion 66 of the actuator 52, as shown in FIG. 1. Fitting 60 is a threaded ferrule with two nuts 68,70 adapted to connect to a housing 13 of dispensing unit 12, also as shown in FIG. 1. Nut 68 is a lock nut and nut 70 is an adjustment nut, whereby the position of flexible member 50 may be adjusted with respect to valve 30 to an appropriate position for actuating the valve 30, and locked into place for consistent actuation.

FIG. 4 is but one example of a flexible elongated member 50 for use in the apparatus of the present invention. It should be understood that variations to the flexible member 50 may be made without departing from the scope of the present invention. For example, the outer sleeve 56 and fittings 58,60 could be eliminated; a wire, cord or other pulling mechanism could be substituted for cable 54; and the cast ends can be replaced with any suitable coupling mechanism for forming operable connections between components.

In FIG. 1, the flexible elongated member 50 is shown connected at cast end 64 to a chain pull assembly 72 for forming the operable connection to the valve 30. The chain pull assembly 72 includes a V-shaped yoke 74 with a coupling or clip 76 that dangles from the point of the yoke 74 and receives the cast ball end 64. The arm portions 78,80 of the yoke 74 are each coupled to a ball chain 46,48, respectively, which are operably connected to the valve 30, or specifically to the magnet cover 36 as depicted with the poppet valve 30 in FIGS. 1 and 3. In that embodiment, the ball chains 46,48 are directed through the dispensing unit 12 such that the vertical motion of the flexible member 50 is converted to the horizontal motion needed to move the magnet cover 36. It should be understood, however, the chain pull assembly is but one example of an operable connection for enabling the valve operation. Moreover, different positioning of the dispensing unit components within the housing may result in different pulling directions needed for actuating the valve 30, and similarly, a different type valve may necessitate a different arrangement for the flexible member and operable connection.

Figure 5A:
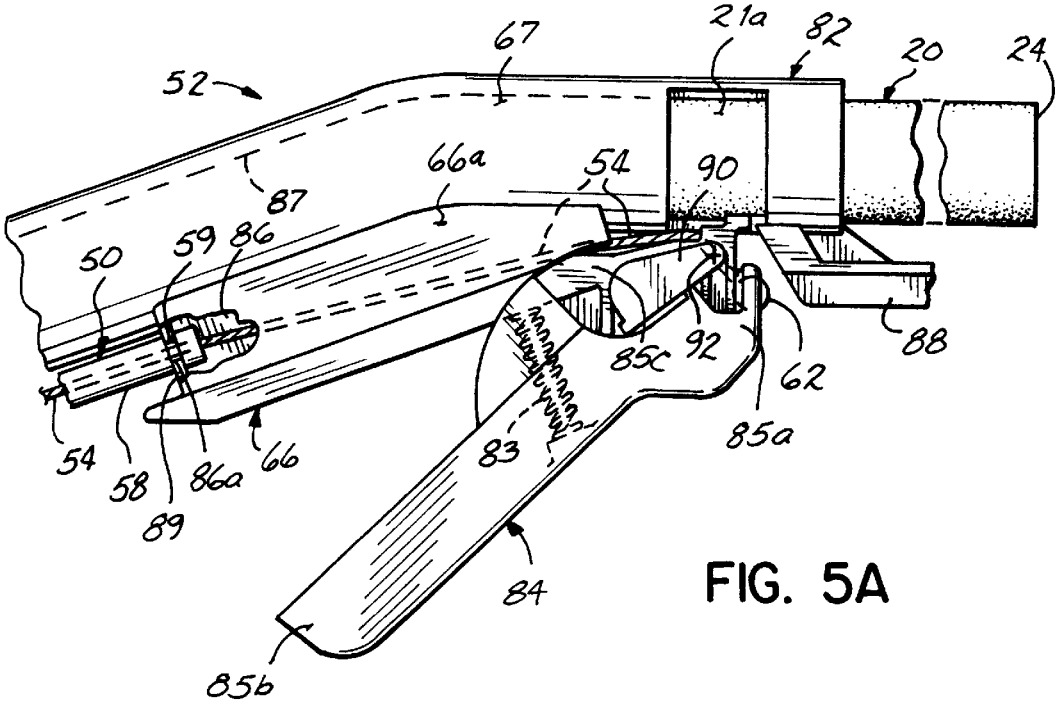
FIG. 5A is a side plan view of an actuating device for use in the present invention in the non-dispensing position.
Figure 5B:
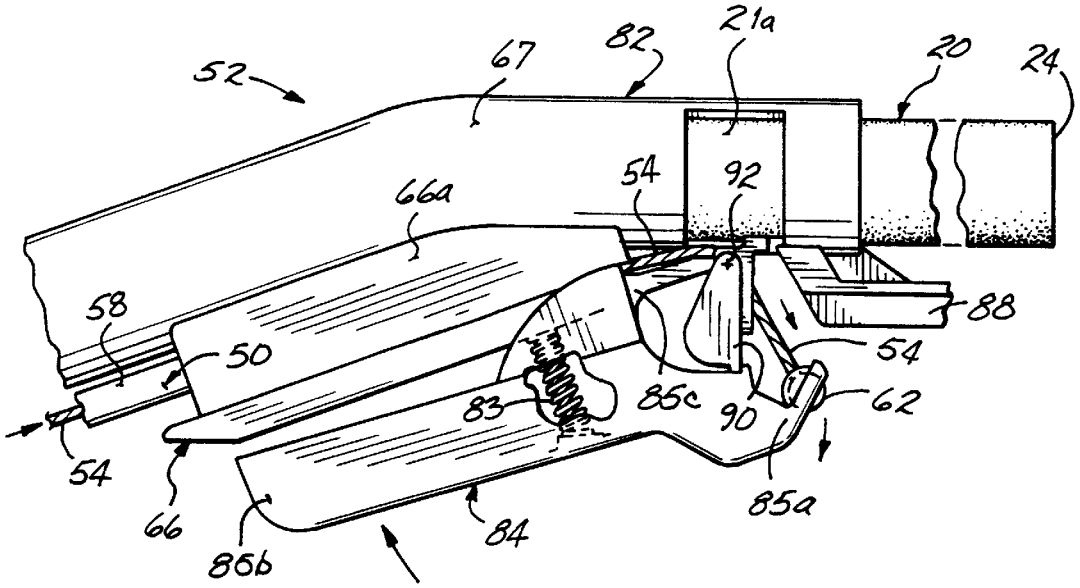
FIG. 5B is a side plan view of the actuating device of FIG. 5A in the locked dispensing position.

FIGS. 1, 5A and 5B depict in further detail an embodiment of an actuator 52 for use in an apparatus of the present invention. In this embodiment, the actuator 52 includes a handle 82 having a lever 84 pivotally attached thereto. A spring 83 may be placed between the handle 82 and lever 84 to assist the return of the lever 84 after it is pressed, and to ease the burden on the magnet spring 32. The handle 82 includes two body portions 66,67 having respectively a cavity 86 and a thru-bore 87. Body portion 66 and thru-bore 86 receive the flexible elongated member 50. In FIG. 5A, the body portion 66 is shown having a slot 86*a* in rear wall 89 of cavity 86 that receives a groove 59 in ferrule 58. The cable 54 and ferrule 58 may then be secured in cavity 86 by a cover 66*a,* which may be screwed on to the body portion 66, for example. Body portion 67 and thru-bore 87 receive the first passageway 21*a* of dispensing tube 20.

The dispensing tube advantageously extends a short length beyond bore 87 to permit the discharge end 24 to be placed in a bucket or other receptacle (not shown) for filling with the fluids from the proportioning dispensing unit 12. The handle 82 may also be equipped with a hook 88 for hanging the dispensing tube 20 when not in use, or for hooking the tube 20 onto the rim of a receptacle to hold the tube 20 in place during dispensing of the fluids.

Fitting 58 shown in FIG. 4 is affixed to the handle 82 in thru-bore 86 and the cable 54 extends through the bore 86 and is operably coupled by cast end 62 to one end 85*a* of lever 84. Upon squeezing and rotating the other end 85*b* of lever 84 about pivot portion 85*c,* the cable 54 is pulled, which thereby actuates the valve 30. FIG. 5A shows the lever 84 in the non-dispensing position with cable 54 suitably relaxed. FIG. 5B shows the pivoted lever 84 in the dispensing position, wherein cable 54 is tensioned. The lever 84 may be locked in the dispensing position by a locking member or clip 90 which is pivotally connected at pivot 92 to the handle 82 or lever 84. Locking members other than a pivoting clip may be used to achieve this function. This locking member may further include an automatic release mechanism that returns the lever 84 to the non-dispensing position when a sufficient amount of fluid has been dispensed.

While although a specific embodiment of an actuator is shown and described herein, it should be understood that numerous actuators may be used without departing from the scope of the present invention. For example, lever 84 could be replaced with a sliding member (not shown) to which flexible member 50 is attached, where the sliding member slides along the length of the handle 82 to pull the flexible member in the direction of the discharge end 24 of the dispensing hose 20.

By way of further explanation, in the embodiment shown in FIG. 1, which incorporates the embodiments of the components in FIGS. 2–5B, upon pressing end 85*b* of lever 84, cable 54 is pulled in the direction of the discharge end 24. The cable 54 consequently pulls downward on the yoke 74 with a vertical motion, which pulls the ball chains 46,48 and magnet cover 36 in a horizontal motion to place the magnet in relation to the valve 30. This magnet placement opens the valve to permit water to flow through valve 30 from inlet 14 into proportioner 18 to mix with chemical fluids. The diluted chemical fluid then flows into the inlet end 22 of dispensing tube 20, through passageway 21*a* and out the discharge end 24.

The invention thus provides for remote activation of the dispensing operation at positions further than arm reach from the dispenser itself. Yet, no shut-off valve is place downstream of a backflow preventer, but rather the shut-off valve remains is a position in the dispenser that is in compliance with regulations requiring it to be so positioned.

While the present invention has been illustrated by the description of embodiments thereof, and while the embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method and illustrative examples shown and described. Accordingly, departures may be made from such details without departing from the scope or spirit of applicant's general inventive concept.

What is claimed is:

1. An apparatus for remotely operating a dispensing unit having a proportioner for combining and dispensing a plurality of fluids in a selected proportion and a valve for passing and cutting off at least one of said fluids, the apparatus comprising:

a dispensing tube having an inlet end and a discharge end, said tube adapted to be in fluid communication with the dispensing unit at the inlet end of the dispensing tube;

an actuator disposed adjacent the discharge end of said dispensing tube; and a flexible elongated member adapted to be operably connected between the valve of the dispensing unit and the actuator such that the valve is adapted to be operated by manipulating the actuator adjacent the discharge end of the tube.

2. The apparatus claim 1, wherein said tube includes a first passageway and a second passageway, the first passageway operably connected to the proportioner for passing said fluids there through and said flexible elongated member being disposed in the second passageway.

3. The apparatus of claim 2, wherein the second passageway is shorter than the first passageway.

4. The apparatus of claim 1, wherein the flexible elongated member includes a stainless steel cable.

5. The apparatus of claim 1, further including a chain pull assembly operably connected to an end of the flexible elongated member, the chain pull assembly adapted to be operably connected to the valve on the dispensing unit.

6. The apparatus of claim 5, wherein the chain pull assembly includes a substantially V-shaped yoke coupled to the end of the flexible elongated member and having first and second arm portions adapted to be operably connected to opposing sides of a magnet cover which houses a magnet movable to open and close the valve, whereby upon manipulation of the actuator, the magnet cover is caused to move thereby moving the magnet to open and close the valve.

7. The apparatus of claim 1, wherein the actuator includes a locking member adapted to hold the actuator in a dispensing position.

8. The apparatus of claim 7, wherein the actuator includes an automatic release mechanism for disengaging the locking member from the dispensing position to a non-dispensing position when a sufficient amount of fluid has been dispensed.

9. The apparatus of claim 1, wherein the actuator includes a handle having a lever pivotally attached to the handle, and the flexible elongated member is operably connected to the lever, whereby the valve is adapted to be operated by manipulating the lever.

10. The apparatus of claim 9, further including a spring mechanism between the handle and the lever.

11. The apparatus of claim 1, wherein the flexible elongated member includes a cable at least partially housed and movable within an outer sleeve, and first and second fittings crimped to a respective end of the sleeve, the first fitting adapted to connect to the dispensing unit and the second fitting adapted to connect to the actuator.

12. The apparatus of claim 1, further comprising a hook member extending from the actuator.

13. An apparatus for remotely operating a dispensing unit having a proportioner for combining and dispensing a plurality of fluids in a selected proportion and a valve for passing and cutting off at least one of said fluids, the apparatus comprising:

a co-extruded dispensing tube having a first passageway and a second passageway, the first passageway having an inlet end and a discharge end, said tube adapted to be in fluid communication with the dispensing unit at the inlet end of the first passageway of the dispensing tube;

a handle disposed adjacent the discharge end of the first passageway of said dispensing tube, the handle having a lever pivotally attached to the handle; and a flexible elongated member disposed in the second passageway of the dispensing tube, the member adapted to be operably connected between the valve on the dispensing unit and the lever on the handle such that the valve is adapted to be actuated by manipulating the lever adjacent the discharge end of the first passageway of the dispensing tube.

14. The apparatus of claim 13, wherein the flexible elongated member includes a stainless steel cable.

15. The apparatus of claim 14, wherein the flexible elongated member includes an outer sleeve in which the cable is movable, and first and second fittings crimped to a respective end of the sleeve, the first fitting adapted to connect to the dispensing unit and the second fitting adapted to connect to the handle.

16. The apparatus of claim 13, further including a chain pull assembly operably connected to an end of the flexible elongated member, the chain pull assembly adapted to be operably connected to the valve on the dispensing unit.

17. The apparatus of claim 13, wherein the handle includes a clip pivotally attached to the handle and adapted to hold the lever in a dispensing position.

18. The apparatus of claim 13, further comprising a hook member extending from the handle.

19. An apparatus for dispensing a plurality of fluids, the apparatus comprising:

a dispensing unit having a proportioner for combining a first fluid and at least a second fluid in a selected proportion and a valve for passing and cutting off at least one of said fluids;

a dispensing tube having an inlet end and a discharge end, said tube in fluid communication with the dispensing unit at the inlet end of the dispensing tube;

an actuator disposed adjacent the discharge end of said dispensing tube; and a flexible elongated member operably connected between the valve on the dispensing unit and the actuator such that the valve is adapted to be operated by manipulating the actuator adjacent the discharge end of the tube.

20. The apparatus claim 19, wherein said tube includes a first passageway and a second passageway, the first passageway operably connected to the proportioner for passing said fluids there through and said flexible elongated member being disposed in the second passageway.

21. The apparatus of claim 20, wherein the second passageway is shorter than the first passageway.

22. The apparatus of claim 19, wherein the flexible elongated member includes a stainless steel cable.

23. The apparatus of claim 19, further including a chain pull assembly operably connected to an end of the flexible elongated member, the chain pull assembly operably connected to the valve on the dispensing unit.

24. The apparatus of claim 23, wherein the valve is a poppet valve including a magnet for opening and closing the valve, and the chain pull assembly includes a substantially V-shaped yoke coupled to the first end of the flexible elongated member and having first and second arm portions operably connected to opposing sides of a magnet cover, whereby upon manipulation of the actuator, the magnet cover is caused to move thereby moving the magnet to open and close the valve.

25. The apparatus of claim 19, wherein the actuator includes a locking member adapted to hold the actuator in a dispensing position.

26. The apparatus of claim 25, wherein the actuator includes an automatic release mechanism for disengaging the locking member from the dispensing position to a non-dispensing position when a sufficient amount of fluid has been dispensed.

27. The apparatus of claim 19, wherein the actuator includes a handle having a lever pivotally attached to the handle, and the flexible elongated member is operably connected to the lever, whereby the valve is adapted to be operated by manipulating the lever.

28. The apparatus of claim 27, further including a spring mechanism between the handle and the lever.

29. The apparatus of claim 19, wherein the valve is a poppet actuated diaphragm valve.

30. The apparatus of claim 19, wherein the flexible elongated member includes a cable at least partially housed and movable within an outer sleeve, and first and second fittings crimped to a respective end of the sleeve, the first fitting adapted to connect to the dispensing unit and the second fitting adapted to connect to the actuator.

31. The apparatus of claim 19, further comprising a hook member extending from the actuator.

32. An apparatus for dispensing a plurality of fluids, the apparatus comprising:

a dispensing unit having a proportioner for combining a first fluid and at least a second fluid in a selected proportion and a valve for passing and cutting off at least one of said fluids;

a dispensing tube having an inlet end and a discharge end, said tube in fluid communication with the dispensing unit at the inlet end of the dispensing tube;

a handle disposed adjacent the discharge end of said dispensing tube, the handle having a lever pivotally attached to the handle; and a flexible elongated member operably connected between the valve on the dispensing unit and the lever on the handle such that the valve is adapted to be actuated by manipulating the lever adjacent the discharge end of the tube.

33. The apparatus claim 32, wherein said tube includes a first passageway and a second passageway, the first passageway operably connected to the proportioner for passing said fluids there through and said flexible elongated member being disposed in the second passageway.

34. The apparatus of claim 33, wherein the second passageway is shorter than the first passageway.

35. The apparatus of claim 32, wherein the flexible elongated member includes a stainless steel cable.

36. The apparatus of claim 35, wherein the flexible elongated member includes an outer sleeve in which the cable is movable, and first and second fittings crimped to a respective end of the sleeve, the first fitting adapted to connect to the dispensing unit and the second fitting adapted to connect to the handle.

37. The apparatus of claim 32, further including a chain pull assembly operably connected to an end of the flexible elongated member, the chain pull assembly operably connected to the valve on the dispensing unit.

38. The apparatus of claim 32, wherein the handle includes a clip pivotally attached to the handle and adapted to hold the lever in a dispensing position.

39. The apparatus of claim 32, further comprising a hook member extending from the handle.

40. An apparatus for dispensing a plurality of fluids, the apparatus comprising:

a dispensing unit having a proportioner for combining a first fluid and at least a second fluid in a selected proportion and a valve for passing and cutting off at least one of said fluids;

a co-extruded dispensing tube having a first passageway and a second passageway, the first passageway having an inlet end and a discharge end, said tube in fluid communication with the dispensing unit at the inlet end of the first passageway of the dispensing tube;

a handle disposed adjacent the discharge end of the first passageway of said dispensing tube, the handle having a lever pivotally attached to the handle; and a flexible elongated member disposed in the second passageway of the dispensing tube, the member operably connected between the valve on the dispensing unit and the lever on the handle such that the valve is adapted to be actuated by manipulating the lever adjacent the discharge end of the first passageway of the dispensing tube.

41. The apparatus of claim 40, wherein the flexible elongated member includes a stainless steel cable.

42. The apparatus of claim 41, wherein the flexible elongated member includes an outer sleeve in which the cable is movable, and first and second fittings crimped to a respective end of the sleeve, the first fitting adapted to connect to the dispensing unit and the second fitting adapted to connect to the handle.

43. The apparatus of claim 40, further including a chain pull assembly operably connected to an end of the flexible elongated member, the chain pull assembly operably connected to the valve on the dispensing unit.

44. The apparatus of claim 40, wherein the handle includes a clip pivotally attached to the handle and adapted to hold the lever in a dispensing position.

45. The apparatus of claim 40, further comprising a hook member extending from the handle.

46. An apparatus for dispensing a plurality of fluids, the apparatus comprising:

a dispensing unit having a proportioner for combining a first fluid and at least a second fluid in a selected proportion and a valve for passing and cutting off at least one of said fluids, the valve including a magnet and a magnet cover;

a co-extruded dispensing tube having a first passageway and a second passageway, the first passageway having an inlet end and a discharge end, said tube in fluid communication with the dispensing unit at the inlet end of the first passageway of the dispensing tube;

a handle disposed adjacent the discharge end of the first passageway of said dispensing tube, the handle having a lever pivotally attached to the handle; and a flexible elongated member disposed in the second passageway of the dispensing tube, the member operably connected at a first end to the magnet cover of the valve on the dispensing unit and operably connected at a second end to the lever on the handle such that upon pressing the lever the magnet cover of the valve is pulled in a direction to move the magnet to place the valve in a fluid dispensing position and upon releasing the lever the magnet cover returns the valve to a closed, non-dispensing position.

47. The apparatus of claim 46, wherein the flexible elongated member includes an outer sleeve in which a cable is movable, and first and second fittings crimped to a respective end of the sleeve, the first fitting adapted to connect to the dispensing unit and the second fitting adapted to connect to the handle, and wherein the cable is connected at a first end to a yoke which connects to opposing sides of the magnet cover and at a second end to the lever.

48. The apparatus of claim 46, wherein the handle includes a clip pivotally attached to the handle and adapted to hold the lever in a dispensing position.

49. The apparatus of claim 46, further comprising a hook member extending from the handle.

* * * * *